US008011379B2

(12) United States Patent
Oh

(10) Patent No.: US 8,011,379 B2
(45) Date of Patent: Sep. 6, 2011

(54) PORTABLE AND COMPACT UMBRELLA

(76) Inventor: Yong Kyun Oh, Seoul (KR)

( * ) Notice: Subject to any disclaimer, the term of this patent is extended or adjusted under 35 U.S.C. 154(b) by 139 days.

(21) Appl. No.: 12/525,541

(22) PCT Filed: Feb. 1, 2008

(86) PCT No.: PCT/KR2008/000640

§ 371 (c)(1),
(2), (4) Date: Aug. 1, 2009

(87) PCT Pub. No.: WO2008/094020

PCT Pub. Date: Aug. 7, 2008

(65) Prior Publication Data

US 2010/0031984 A1 Feb. 11, 2010

(30) Foreign Application Priority Data

Feb. 2, 2007 (KR) ..... 10-2007-0011136
Jan. 31, 2008 (KR) ..... 10-2008-0010036

(51) Int. Cl.
*A45B 19/04* (2006.01)
*A45B 25/02* (2006.01)

(52) U.S. Cl. ..... 135/25.4; 135/19; 135/25.1; 135/25.41

(58) Field of Classification Search ..... 135/15, 135/19, 19.5, 20.3, 22, 24, 25.1, 25.4, 29, 135/31, 25.41
See application file for complete search history.

(56) References Cited

U.S. PATENT DOCUMENTS 2,282,695 A * 5/1942 Badovinac ..... 135/25.3
3,435,836 A * 4/1969 Vanzini ..... 135/22
3,825,024 A 7/1974 Cohen
3,954,117 A * 5/1976 Wallace ..... 135/20.2
6,273,111 B1 * 8/2001 Weiss et al. ..... 135/25.41

FOREIGN PATENT DOCUMENTS

| | | | |
|---|---|---|---|
| DE | 4008212 | | 9/1991 |
| FR | 2681224 | A1 * | 3/1993 |
| GB | 2346556 | A * | 8/2000 |
| JP | 09037825 | A * | 2/1997 |
| JP | 2001029115 | A * | 2/2001 |
| JP | 2002125733 | A * | 5/2002 |

(Continued)

OTHER PUBLICATIONS

The extended European search report for PCT/KR2008000640.

*Primary Examiner* — Winnie Yip
(74) *Attorney, Agent, or Firm* — Portland IP Law LLC

(57) ABSTRACT

The present invention relates to a portable and compact umbrella capable of being folded compactly without exposing umbrella ribs and umbrella cloth thereby being easily carried and stored. A portable and compact umbrella according to the present invention includes an extendable umbrella stick extended and retracted to change its length, wherein the extendable umbrella stick has a sheltering means provided at one side thereof and a fixing protrusion provided at the other side thereof; and a handle member having both ends communicating with each other and a receiving space defined therein, wherein the receiving space is partitioned by a cylindrical winding unit, the winding unit has an inner space formed inside thereof so that the extendable umbrella stick is retracted and received in the inner space, and the winding unit has an outer space formed outside thereof so that the sheltering means is wound around the winding unit and received in the outer space.

19 Claims, 8 Drawing Sheets

FOREIGN PATENT DOCUMENTS

| | | | | |
|---|---|---|---|---|
| JP | 2003-169707 | | | 6/2003 |
| JP | 2005224549 | A | * | 8/2005 |
| KR | 20-0236561 | | | 10/2001 |
| KR | 20-0271189 | | | 4/2002 |
| KR | 2003-0041925 | | | 5/2003 |
| KR | 20-0396893 | | | 9/2005 |
| KR | 10-2007-0005066 | | | 1/2007 |
| KR | 10-0779231 | | | 11/2007 |
| KR | 10-0793474 | | | 3/2008 |
| WO | 9748303 | | | 12/1997 |

* cited by examiner

【Figure 1】 PRIOR ART
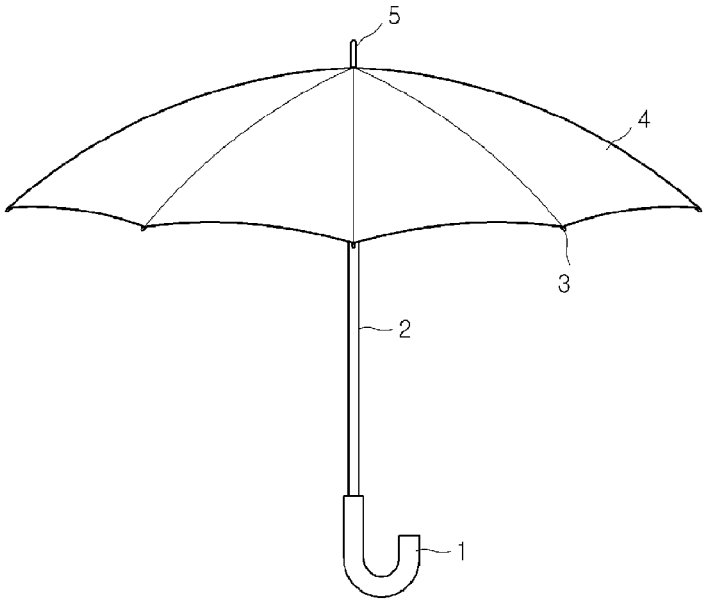
【Figure 2】
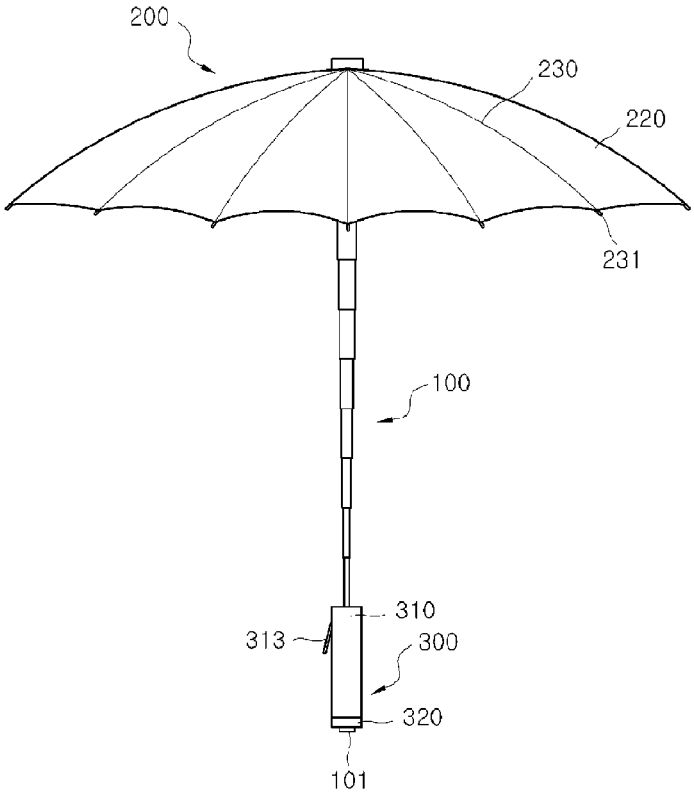

【Figure 3】
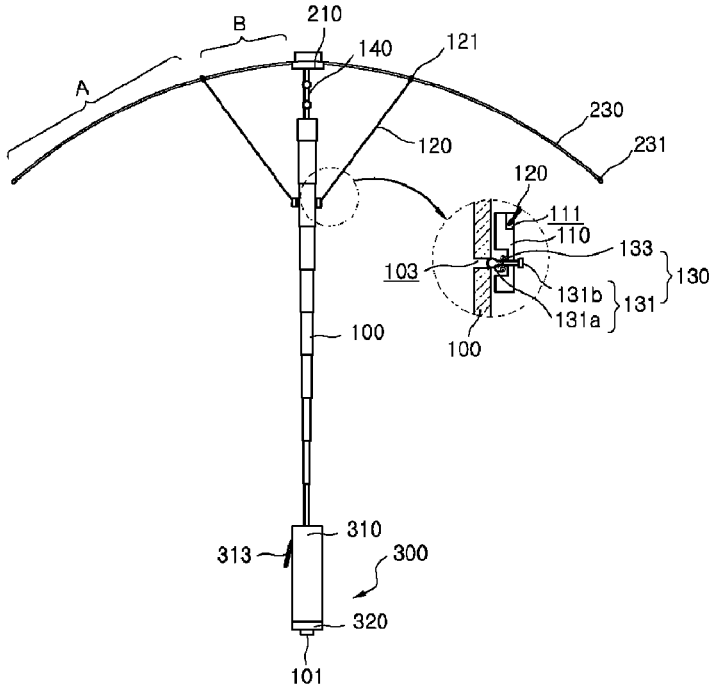
【Figure 4】
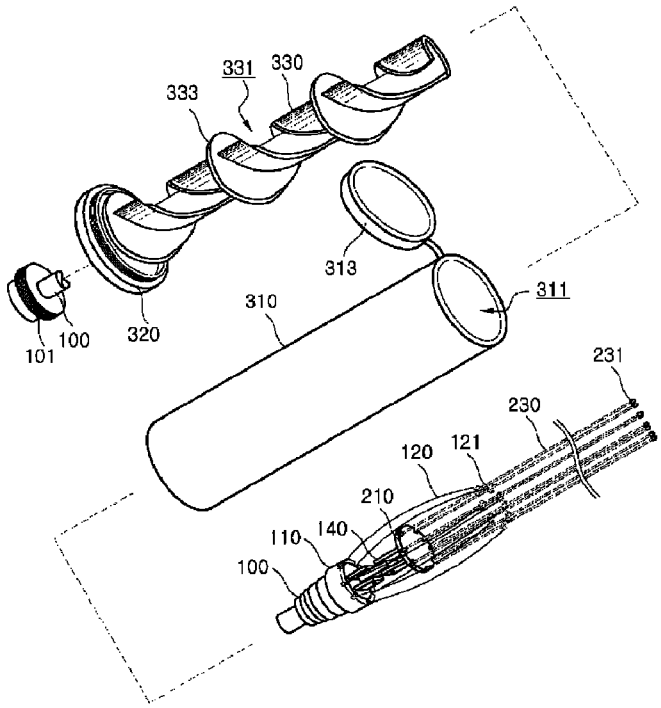

[Fig. 5]
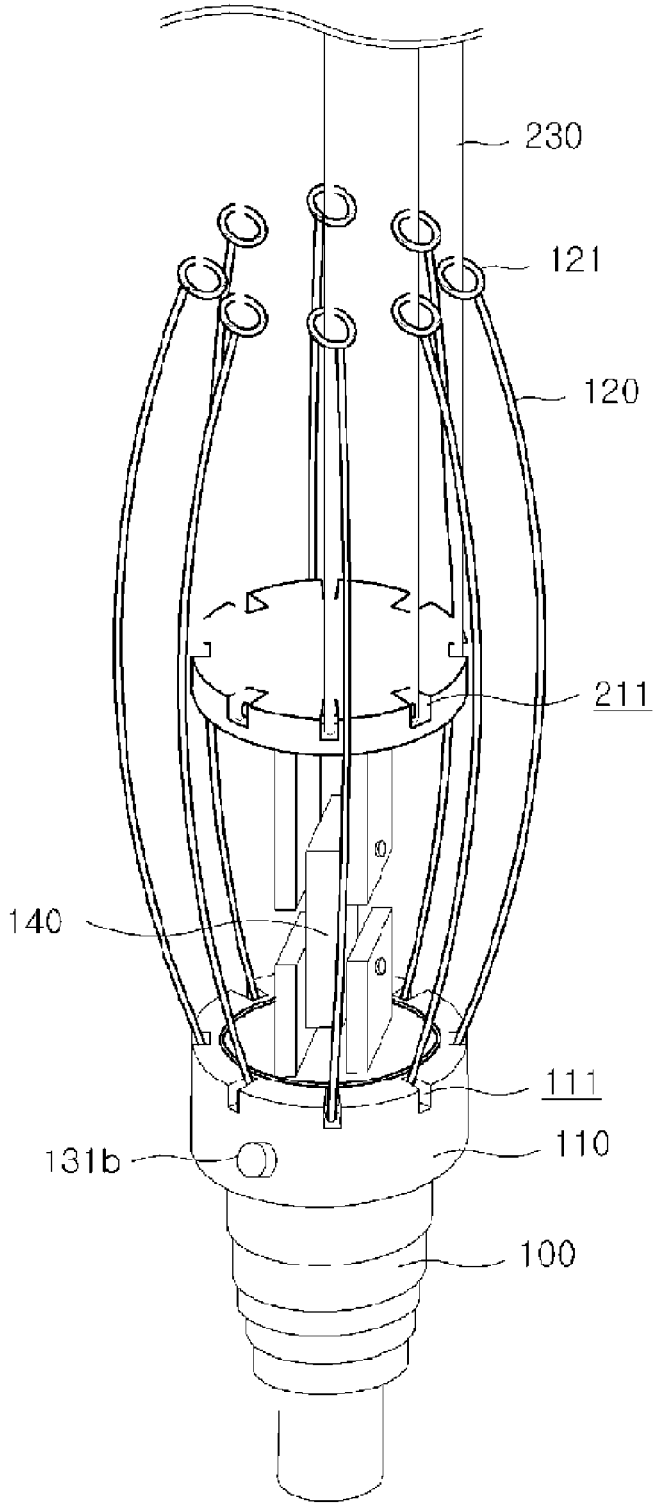

[Fig. 6]
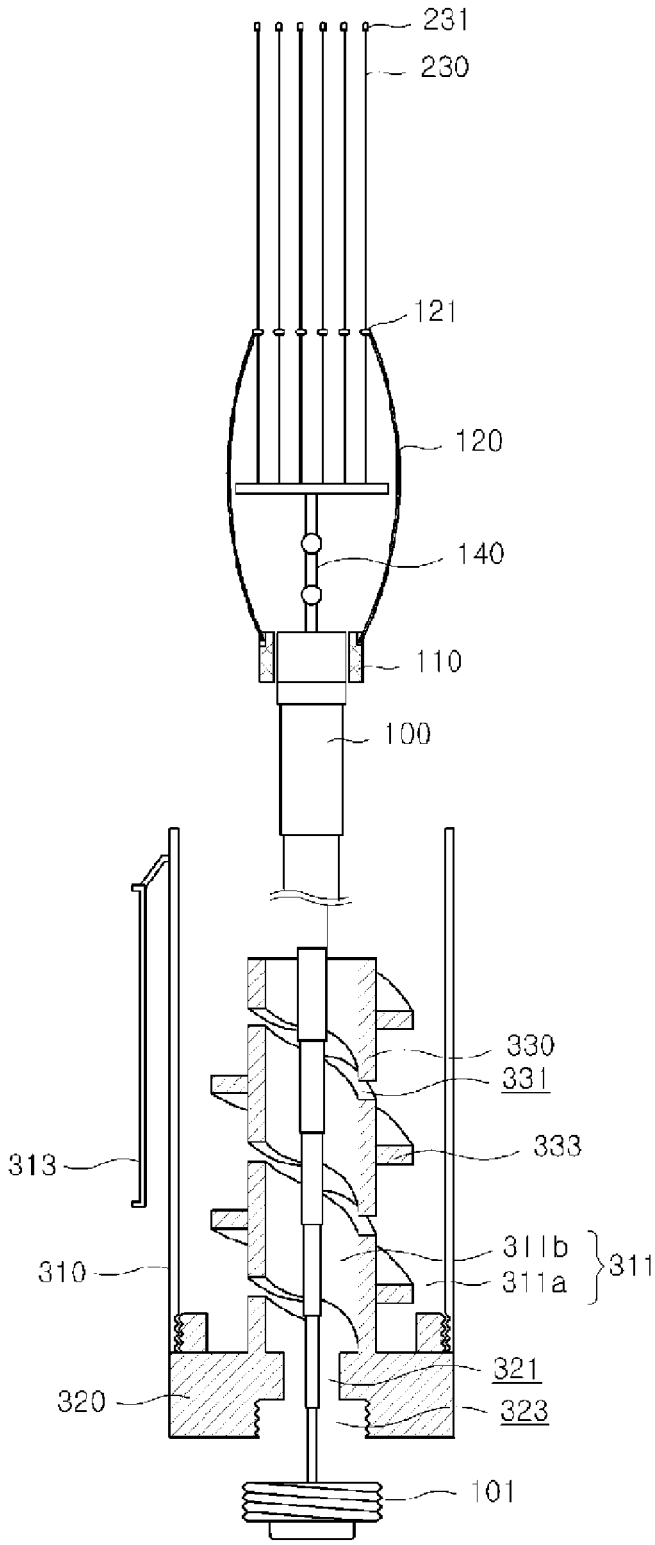

[Fig. 7]
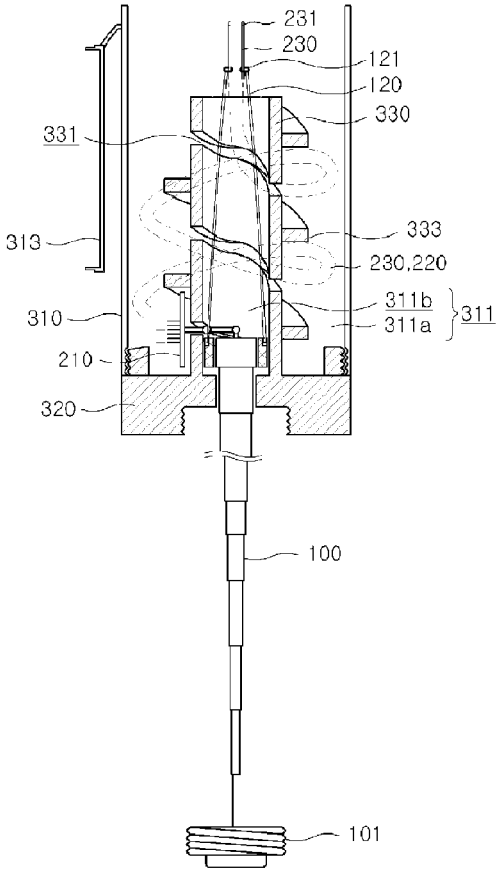
[Fig. 8]
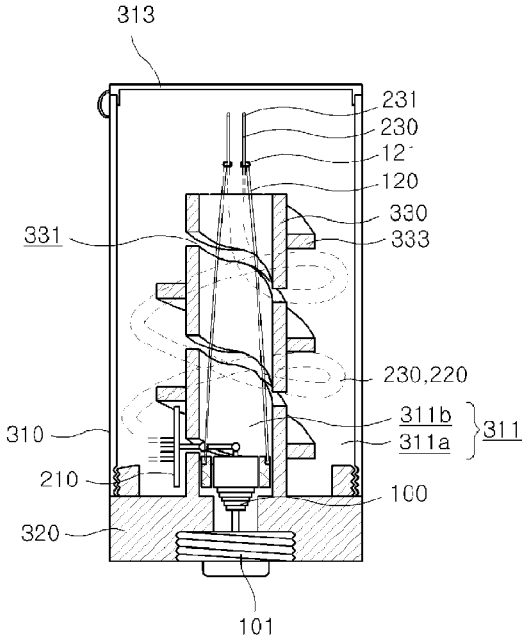

[Fig. 9]
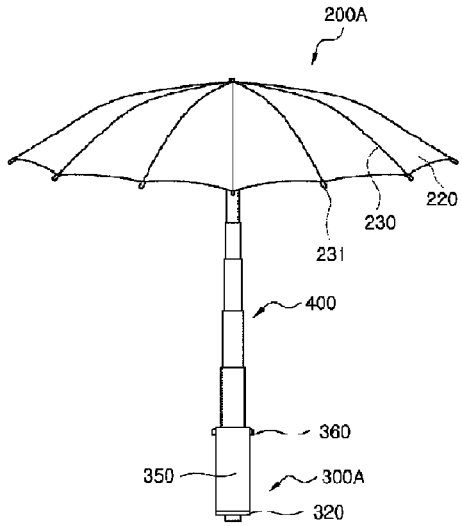
[Fig. 10]
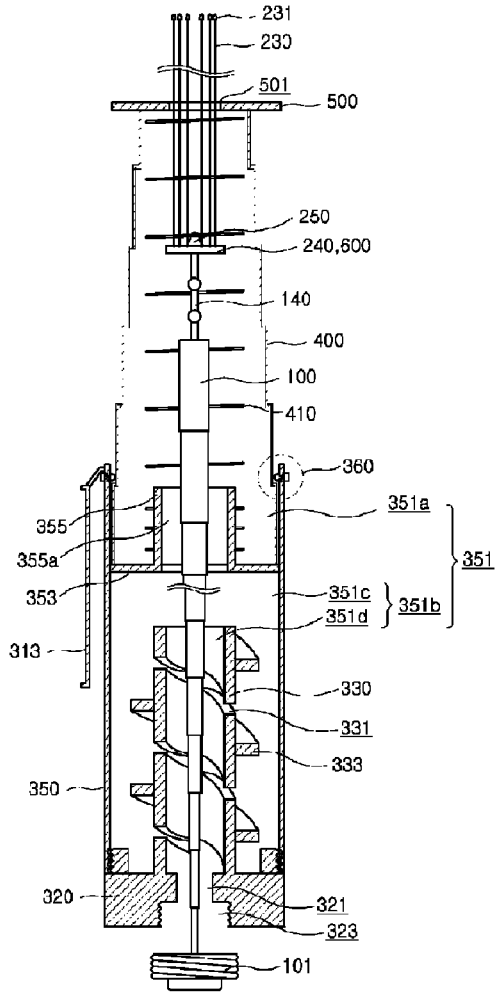

[Fig. 11]
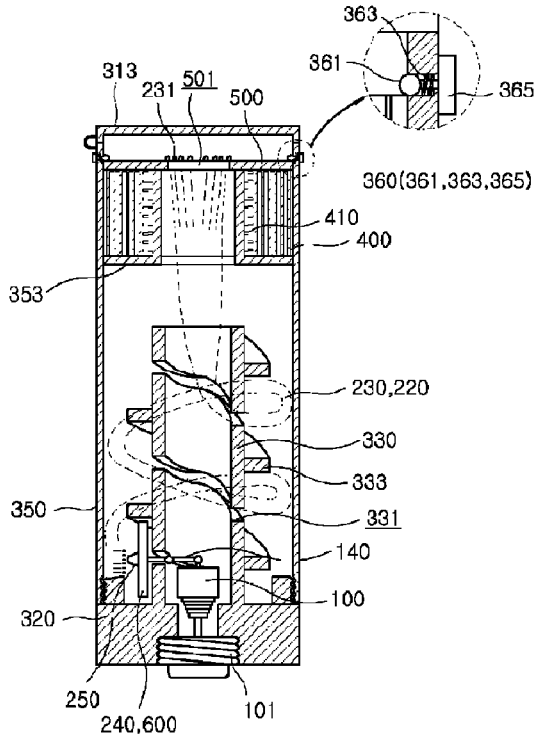
[Fig. 12]
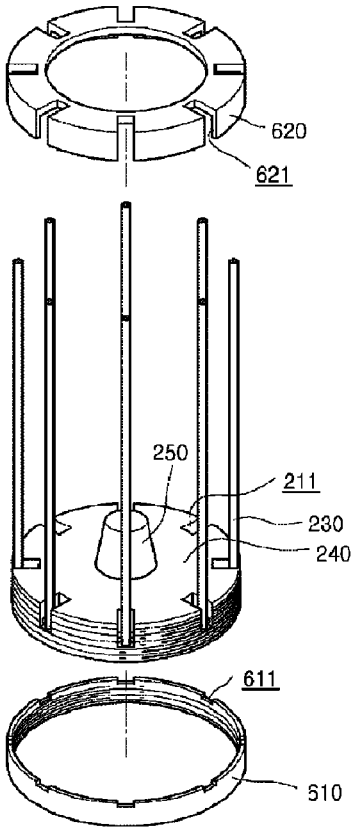

[Fig. 13]
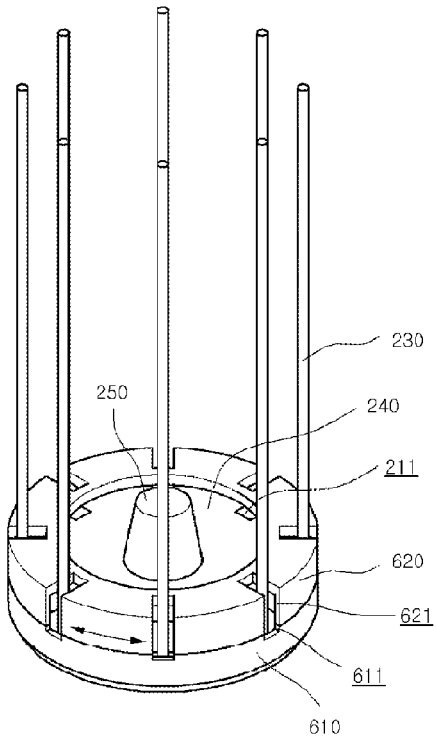
[Fig. 14]
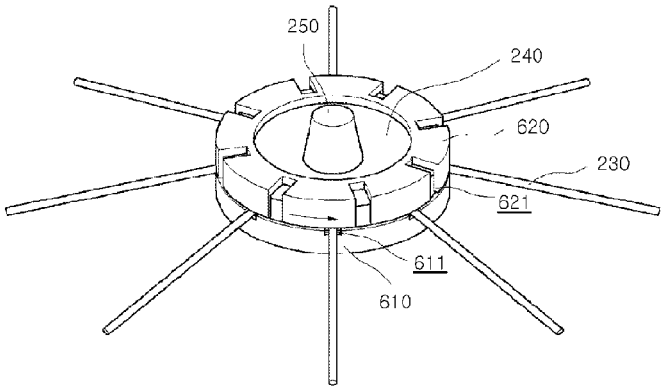
[Fig. 15]
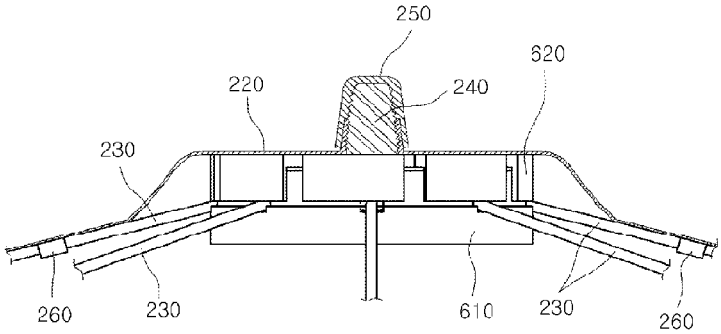

PORTABLE AND COMPACT UMBRELLA

TECHNICAL FIELD

The present invention relates to a portable and compact umbrella, and more particularly to a portable and compact umbrella capable of being accommodated compactly without exposing umbrella ribs or umbrella cloth to be easily carried and stored.

BACKGROUND ART

Generally, as shown in FIG. 1, an umbrella includes a handle 1 gripped by a hand, an umbrella stick 2 extending upwardly from the handle 1, metal umbrella ribs 3 radially installed to an upper end of the umbrella stick 2 to keep the shape of the umbrella, support ribs (not shown) for folding and unfolding the umbrella ribs 3 and the umbrella stick 2, a waterproof cloth 4 fixedly installed over the umbrella ribs 3 such that a user can be protected from the rain or snow, and an umbrella end cap 5 for preventing the waterproof cloth 4 from being separated from the umbrella ribs 3.

When using the umbrella so configured, a user grips the handle 1 and the umbrella ribs 3 and then unfolds the waterproof cloth 4. On the other hand, when the umbrella is not used, a user grips one side of the umbrella ribs and then pulls them toward the handle 1 for storage.

Conventionally, in order to easily carry and store the umbrella, the waterproof cloth 4 is folded and brought into close contact with the umbrella stick, or the umbrella stick 2 and the waterproof cloth 4 are folded at least two times to make the umbrella small.

However, there is a limit to folding the conventional umbrella and making it small, and particularly, it is not easy to carry the conventional umbrella.

Further, in a case where the umbrella should be folded and carried after the umbrella is used in the rainy weather, if the umbrella is folded for carrying, the waterproof cloth covered with rain drops is exposed to the outside as it is, thereby causing inconvenience in carrying. Thus, there is a problem in that an additional umbrella sheath for receiving the umbrella should be carried.

DISCLOSURE OF INVENTION

Technical Problem

The present invention is conceived to solve the aforementioned problems. An object of the present invention is to provide a portable and compact umbrella capable of being compactly accommodated without exposing umbrella ribs or waterproof cloth to be easily carried and stored.

Technical Solution

According to an aspect of the present invention for achieving the objects, there is provided a portable and compact umbrella, which includes an extendable umbrella stick extended and retracted to change its length, wherein the extendable umbrella stick has a sheltering means provided at one side thereof and a fixing protrusion provided at the other side thereof; and a handle member having both ends communicating with each other and a receiving space defined therein, wherein the receiving space is partitioned by a cylindrical winding unit, the winding unit has an inner space formed inside thereof so that the extendable umbrella stick is retracted and received in the inner space, and the winding unit has an outer space formed outside thereof so that the sheltering means is wound around the winding unit and received in the outer space.

At this time, a screw hole and a screw protrusion may be formed to be spaced apart from each other on an outer circumference of the winding unit so that the sheltering means is wound thereon.

In addition, the sheltering means may include a support member installed to an upper end of the extendable umbrella stick; a sheltering member installed to the support member; and a plurality of flexible umbrella ribs provided at regular intervals for supporting the sheltering member in the rear thereof, wherein one ends of the umbrella ribs are radially coupled to the support member.

At this time, a link member having at least one stage may be provided at the upper end of the extendable umbrella stick, whereby the extendable umbrella stick is connected to the support member through the link member.

Further, the umbrella ribs may be pivotally installed to first installation grooves formed on the support member, respectively.

In addition, the support member may have an outer diameter larger than an inner diameter of the winding unit.

Furthermore, the portable and compact umbrella may further include a ring-type lifting member moving up and down along an outer circumference of the extendable umbrella stick and provided to be fixed to or released from a point of the extendable umbrella stick; and fixing ribs having one ends radially installed to the lifting member and the other ends installed to the umbrella ribs and sliding along the umbrella ribs, respectively.

At this time, a ring may be formed at the other end of each fixing rib so that the corresponding umbrella rib is inserted therein, whereby the ring prevents the fixing rib from escaping from the umbrella rib.

In addition, the fixing ribs may be pivotally installed to second installation grooves formed on the lifting member, respectively.

Further, the lifting member may have an outer diameter smaller than an inner diameter of the winding unit.

Also, the handle member may include a case having both ends communicating with each other and having an upper cover for covering one of end openings of the case and a lower cover screwed to the other of the end openings thereof; the winding unit is integrally formed at one end of the lower cover; and a fixing groove is formed on the other end of the lower cover, wherein the fixing protrusion of the extendable umbrella stick is screwed to the fixing groove.

According to another aspect of the present invention, there is provided a portable and compact umbrella, which includes an outer umbrella stick extended and retracted to change its length, an extendable umbrella stick provided inside of the outer umbrella stick to be extended and retracted and change its length; a support member installed at an upper end of the extendable umbrella; a sheltering member installed to the support member; a plurality of flexible umbrella ribs provided in the rear of the sheltering member at regular intervals to support the sheltering member, wherein one ends of the umbrella ribs are radially coupled to the support member; an adjusting member installed to the support member to control the umbrella ribs to be unfolded or gathered; a pressing member installed to an upper end the outer umbrella stick to press the outer umbrella stick when the outer umbrella stick is retracted, wherein the pressing member has a first through hole so that the umbrella ribs and the sheltering member connected to the support member pass through the first through hole; a handle member having both ends communicating with each other and a receiving space defined therein, wherein the receiving space is partitioned into an upper space and a lower space by a partitioning unit, the outer umbrella stick is retracted and received in the upper space, the lower space is partitioned by a cylindrical winding unit, the winding unit has an inner space formed inside thereof so that the extendable umbrella stick is retracted and received in the inner space, and the winding unit has an outer space formed outside thereof so that the umbrella ribs and the sheltering member are wound around the winding unit and received in the outer space; a catching device installed to an upper end of the handle member to catch or release the pressing member; and a spring member installed in the outer umbrella stick to provide elastic force so that the outer umbrella stick is extended out of the handle member.

At this time, a screw hole and a screw protrusion may be formed to be spaced apart from each other on an outer circumference of the winding unit so that the umbrella ribs and the sheltering member are wound thereon.

In addition, a catching protrusion wider than a cross sectional area of each umbrella rib may be provided on the other end of the umbrella rib, wherein the catching protrusion is caught to the first through hole and protrudes above the pressing member when the outer umbrella stick is retracted.

The handle member may include a case having both ends communicating with each other and having an upper cover for covering one of end openings of the case and a lower cover screwed to the other of the end openings thereof; the winding unit is integrally formed at one end of the lower cover; and a fixing groove is formed on the other end of the lower cover, wherein the fixing protrusion of the extendable umbrella stick is screwed to the fixing groove.

In addition, a seating unit may be formed in the upper space of the handle member to integrally extend from the partitioning unit so that the spring member is seated on the seating unit, wherein the seating unit is formed with a second through hole so that the extendable umbrella stick, and the support member and the adjusting member pass through the second through hole.

Further, the adjusting member may include a lower adjusting member screwed to an upper portion of an outer circumference of the support member to be movable up and down, wherein the lower adjusting member is formed with lower grooves at positions corresponding to the umbrella ribs so that the umbrella ribs are seated therein; and an upper adjusting member screwed to a lower portion of the outer circumference of the support member to be movable up and down, wherein the upper adjusting member is formed with upper grooves at positions corresponding to the umbrella ribs so that the umbrella ribs passes through the upper grooves when the umbrella ribs are gathered.

Furthermore, a link member having at least one stage may be provided at the upper end of the extendable umbrella stick so that the extendable umbrella stick is connected to the support member through the link member.

Moreover, the catching device may include a ball for pressing and supporting an upper surface of the pressing member; a spring for pushing the ball toward the support member; and an adjusting unit connected to the ball to retreat the ball.

Advantageous Effects

According to the present invention, since a sheltering member, umbrella ribs and the like are compactly received into a handle member not to be exposed to the outside, an umbrella can be easily carried and stored.

In addition, the sheltering member is received in the handle member even when an umbrella covered with rain drops is stored, whereby the water drops do not stain surrounding articles, and the umbrella can be stored safely.

BRIEF DESCRIPTION OF THE DRAWINGS

FIG. 1 is a schematic view showing a general umbrella;

FIG. 2 is a schematic view showing an external appearance of a portable and compact umbrella according to the present invention;

FIG. 3 is a schematic view showing the configuration of the portable and compact umbrella according to the present invention;

FIG. 4 is an exploded perspective view showing the portable and compact umbrella according to the present invention;

FIG. 5 is a perspective view showing a major portion of the portable and compact umbrella according to the present invention;

FIG. 6 is a schematic sectional view showing the portable and compact umbrella according to the present invention;

FIGS. 7 and 8 are sectional views showing operating states when the portable and compact umbrella according to the present invention is stored;

FIG. 9 is a schematic view showing a portable and compact umbrella according to another embodiment of the present invention;

FIGS. 10 and 11 are sectional view showing the configuration and operation of the portable and compact umbrella according to the other embodiment of the present invention;

FIG. 12 is an exploded perspective view showing a support member and an adjusting member of the portable and compact umbrella according to the other embodiment of the present invention;

FIGS. 13 and 14 are perspective views of an assembled state illustrating the operation of the portable and compact umbrella of FIG. 12; and FIG. 15 is a sectional view showing a coupled state of a sheltering member and umbrella ribs according to the other embodiment of the present invention.

BEST MODE FOR CARRYING OUT THE INVENTION

Hereinafter, preferred embodiments of portable and compact umbrella according to the present invention will be described in detail with reference to the accompanying drawings. However, the present invention is not limited to the embodiments disclosed below but may be implemented into different forms. These embodiments are provided only for illustrative purposes and for full understanding of the scope of the present invention by those skilled in the art. Throughout the drawings, like reference numerals are used to designate like elements.

FIG. 2 is a schematic view showing an external appearance of a portable and compact umbrella according to the present invention; FIG. 3 is a schematic view showing the configuration of the portable and compact umbrella according to the present invention; FIG. 4 is an exploded perspective view showing the portable and compact umbrella according to the present invention; FIG. 5 is a perspective view showing a major portion of the portable and compact umbrella according to the present invention; and FIG. 6 is a schematic sectional view showing the portable and compact umbrella according to the present invention.

As shown in the figures, a portable and compact umbrella according to the embodiment of the present invention generally includes an extendable umbrella stick 100, a sheltering means 200 and a handle member 300.

The extendable umbrella stick 100 is folded like antenna to be extendable and retractable and thus its length can be changed, wherein the sheltering means 200 is provided at one side of the extendable umbrella stick 100 and a fixing protrusion 101 is provided at the other side thereof.

The extendable umbrella stick 100 is configured in a multistage manner, and although not shown, grooves and protrusions may be formed at contact portions of the respective stages such that the extendable umbrella stick 100 can be maintained in its extended or retracted state.

The fixing protrusion 101 is gripped by a user when the user intends to retract the extendable umbrella stick 100 or is to fix the extendable umbrella stick 100 to the handle member 300. Preferably, the fixing protrusion 101 is configured integrally with the extendable umbrella stick 100 and has a thread formed on a portion or whole of an outer circumference thereof. In this embodiment, no thread is formed in a portion gripped by a user. Of course, the fixing protrusion 101 is not limited to the thread coupling type as long as it can fix the extendable umbrella stick to the handle member 300.

The sheltering means 200 includes a support member 210 installed to an upper end of the extendable umbrella stick 100, a sheltering member 220 installed to the support member 210, and a plurality of umbrella ribs 230 provided at regular intervals for supporting the sheltering member 220 in the rear of the sheltering member 220.

The support member 210 has a circular plate shape, and first installation grooves 211 are formed at regular intervals along a circumference of the support member 210 such that the umbrella ribs 230 can be coupled thereto. At this time, each first installation groove 211 is open in upper and side directions such that the umbrella rib 230 can be gathered in an upper direction of the support member 210 or spread in a side direction of the support member 210. Thus, the umbrella rib 230 is hinged to pivot in the upper or side direction at the first installation grooves 211.

At this time, the first installation grooves 211 are preferably formed corresponding to the umbrella ribs 230 in number.

Also, the support member 210 is preferably formed to have the outer diameter larger than the inner diameter of a winding unit 330, which will be described later. Thus, when the extendable umbrella stick 100 is retracted, the support member 210 is prevented from being inserted into an inner space 311*b* of the winding unit 330.

In addition, a link member 140 having at least one stage is provided between the extendable umbrella stick 100 and the support member 210, thereby connecting the extendable umbrella stick 100 and the support member 210. Thus, the support member 210 is freely pivotable at the upper end of the extendable umbrella stick 100. In this embodiment, the link member 140 is designed to have two stages for easy pivoting. In addition, the link member 140 can be rotatably installed at the end of the extendable umbrella stick 100.

The sheltering member 220 is a means provided for sheltering a user from snow, rain or sun and made of waterproof cloth or vinyl. The umbrella ribs 230 and the sheltering member 220 may be fixed and supported in various ways, for example, by taping adhesion, bonding adhesion, heating adhesion or the like.

The umbrella ribs 230 are installed to the support member 210 and serves to be folded or unfolded together with the sheltering member 220 according to the spreading or gathering operation. Also, the umbrella ribs 230 allow the sheltering member 220 to be maintained in an unfolded state. The umbrella ribs 230 should be flexible so that they can be wound around the winding unit 330, which will be described later. To this end, the umbrella ribs 230 are preferably made by plastic injection molding. In addition, a catching protrusion 231 is formed at an end of each umbrella rib 230. At this time, the umbrella rib 230 and the catching protrusion 231 may be integrally formed by plastic injection molding.

In addition, the umbrella of the present invention further includes a lifting member 110, which moves up and down along the outer circumference of the extendable umbrella stick 100 and can be fixed to or released from a certain point of the extendable umbrella stick 100; and fixing ribs 120, each of which has one end radially installed to the lifting member 110 and the other end installed to the umbrella rib 230 to slide along the umbrella rib 230.

The lifting member 110 is preferably formed in the shape of a ring having an inner diameter larger than the outer diameter of the extendable umbrella stick 100 such that the lifting member 110 can move up and down along the outer circumference of the extendable umbrella stick 100. Also, second installation grooves 111 are formed in the circumference of the lifting member 110 at regular intervals such that the fixing ribs 120 can be coupled thereto. At this time, each second installation groove 111 is open in upper and side directions such that the fixing rib 120 can be gathered in the upper direction or spread in the side direction. Thus, the fixing ribs 120 are hinged to pivot in the upper and side directions at the second installation grooves 111.

In addition, the lifting member 110 is preferably formed to have an outer diameter smaller than the inner diameter of the winding unit 330, which will be described later. Thus, when the extendable umbrella stick 100 is retracted, the lifting member 110 is inserted into the inner space 311*b* of the winding unit 330 together with the extendable umbrella stick 100.

Also, a catching member 130 is provided in the lifting member 110 such that the catching member 130 can be fixed to or released from a certain point of the extendable umbrella stick 100.

The catching member 130 includes a fixing pin 131 perforated and installed through the lifting member 110, and a spring 133 for providing elastic fore to the fixing pin 131. Thus, the fixing pin 131 has a ball 131*a* provided at one end of the fixing pin 131 such that a body of the ball 131*a* is partially inserted into and fixed to a certain point of the extendable umbrella stick 100, for example, an insert hole 103 thereof; and an adjusting unit 131*b* formed integrally with the ball 131*a* at the other end of the fixing pin 131 so as to retreat the ball 131*a*. In addition, the spring 133 is interposed between the ball 131*a* and the lifting member 110 to push the ball 131*a* into the insert hole of the extendable umbrella stick 100. The insert hole 103 is preferably bored through a certain point of the extendable umbrella stick 100 or formed in a shape of a groove. Of course, the catching member 130 is not limited to the pin type proposed in this embodiment, but may be implemented in any other manner if it can fix or release the lifting member 110 to or from a certain point of the extendable umbrella stick 100.

In addition, the fixing ribs 120 serve to support the umbrella ribs 230 to be maintained in the unfolded state. Thus, the fixing ribs 120 should maintain strength enough to keep the unfolded state of the umbrella ribs 120. One end of each fixing rib 120 is hinged to the second installation groove 111 of the lifting member 110 to pivot thereon. Also, a ring 121 is formed at the other end of each fixing rib 120 such that the umbrella rib 230 can be inserted therein. Thus, the umbrella rib 230 is inserted into the ring 121. In addition, the ring 121 naturally slides between the catching protrusion 231 of the umbrella rib 230 and an end of a connecting portion of the sheltering member 220 and the umbrella rib 230. Thus, the umbrella rib 230 and the sheltering member 220 are supported to be spaced apart from each other in a region "A" of FIG. 2, and has the connecting portion formed in a region "B" to restrain a sliding region of the ring 121.

The handle member 300 includes a case 310 having both ends communicating with each other to form a receiving space 311 therein and having an upper cover 313 for covering one of the end openings of the case 310; a lower cover 320 screwed to the other of the end openings of the case 310; and a cylindrical winding unit 330 integrally provided at one end of the lower cover 320 to partition the receiving space 311 of the case 310 into an inner space 311*b* and an outer space 311*a*.

The lower cover 320 is formed with a hole 321 communicating with the winding unit 330, and a fixing groove 323, to which the fixing protrusion 101 of the extendable umbrella stick 100 is screwed, is formed in the other end of the lower cover 320, preferably in an end of the hole 321. In this embodiment, the hole 321 and the fixing groove 323 are designed to have different inner diameters, but the present invention is not limited thereto. That is, the hole 321 and the fixing groove 323 may have the same inner diameter.

The winding unit 330 partitions the receiving space 311 of the case into the inner space 311*b* and the outer space 311*a*, so that the extendable umbrella stick 100 is retracted and then received in the inner space 311*b*, and the sheltering means 200, i.e., the umbrella ribs 230 and the sheltering member 220, is wounded and received in the outer space 311*a*. Thus, a screw hole 331 and a screw protrusion 333 are formed in the outer circumference of the winding unit 330 such that the sheltering means 200 is wound on the outer circumference of the winding unit 330.

The screw hole 331 is formed in the shape of a screw along the outer circumference of the winding unit 330 to pass through the inner and outer sides of the winding unit 330, and is preferably formed with a width so that the link member 140 connecting the extendable umbrella stick 100 and the support member 210 can be inserted and guided in the screw hole. Thus, when the extendable umbrella stick 100 is retracted, the support member 210 is not inserted into the inner space 311*b* of the winding unit 330, but is wound along the outer circumference of the winding unit 330 at the same time as the link member 140 is guided by the screw hole 331. At this time, the umbrella ribs 230 and the sheltering member 220 connected to the support member 210 are wound along the outer circumference of the winding unit 330 integrally with the support member 210 and then received in the outer receiving space 311. Here, the support member 210, the umbrella ribs 230 and the sheltering member 220 are preferably guided and wound by the screw protrusion 333, thereby preventing them from getting tangled.

Thus, the screw hole 331 is opened to the upper end of the winding unit 330. At this time, a guide protrusion (not shown) may be formed on the circumference of the screw hole 331 formed at the upper end of the winding unit 330 such that the link member 140 can preferably enter the screw hole 331. In addition, the width of the screw hole 331 formed at the upper end of the winding unit 330 is wider at its end and gradually narrows, which causes the link member 140 to preferably enter the screw hole 331.

The operation of the portable and compact umbrella so configured according to the present invention will be described.

FIGS. 7 and 8 are sectional views showing operating states when the portable and compact umbrella according to the present invention is stored.

First, a case where the portable and compact umbrella according to the present invention is used will be described with reference to FIG. 3.

When intending to use the umbrella, a user extends the extendable umbrella stick 100 to the maximum and then fixes the fixing protrusion 101 into the fixing groove 323 thereby fixing the extendable umbrella stick 100 to the handle member 300. Then, the user moves down the lifting member 110 and fixes the lifting member 110 to the extendable umbrella stick 100 using the fixing pin 131. In that case, as the fixing ribs 120 move down together, the rings 121 slide in the region "A" along the umbrella ribs 230 to unfold the umbrella ribs 230. If the umbrella ribs 230 are unfolded, the sheltering member 220 is also unfolded together.

The user uses the umbrella with the sheltering member 220 unfolded as mentioned above, and if the user wants to store the umbrella, the user separates the fixing pin 131 from the extendable umbrella ribs 230 as shown in FIG. 6 and then moves the lifting member 110 upward along the extendable umbrella ribs 230 to gathering the umbrella ribs 230. In that case, the fixing ribs 120 are also gathered together with the umbrella ribs 230. At this time, the rings 121 of the fixing ribs 120 are guided and slide along the umbrella ribs 230, so that the umbrella ribs 230 and the fixing ribs 120 are gathered smoothly. The sheltering member 220 is also gathered together with the umbrella ribs 230.

If the umbrella ribs 230, the fixing ribs 120 and the sheltering member 220 are gathered with the extendable umbrella stick 100 in a straight line, the user pulls down the fixing protrusion 101 provided at the lower end of the extendable umbrella stick 100. Then, as shown in FIG. 7, the extendable umbrella stick 100 passes through the winding unit 330 and advances downward, and the support member 210 provided at the upper end of the extendable umbrella stick 100 cannot pass through the upper end of the winding unit 330, but the link member 140 connecting the support member 210 with the extendable umbrella stick 100 is bent and then slidingly inserted into the screw hole 331. If the user keeps pulling the extendable umbrella stick 100 in this state, the link member 140 rotates and moves down along the screw hole 331, and at the same time, the support member 210, the umbrella ribs 230 and the sheltering member 220 are wound on the outer circumference of the winding unit 330. At this time, the support member 210, the umbrella ribs 230 and the sheltering member 220 are received in the outer space 311*a* along the screw protrusion 333 formed on the outer circumference of the winding unit 330 without getting tangled.

At this time, the lifting member 110 passes through the upper end of the winding unit 330 and then enters the inner space 311*b* of the winding unit 330 together with the extendable umbrella stick 100. In that case, the fixing ribs 120 also enter the inner space 311*b* of the winding unit 330 together with the lifting member 110. At this time, the rings 121 provided at the ends of the fixing ribs 120 slide and move up along the umbrella ribs 230 in the region "A" whereby the umbrella ribs 230 are not prevented from being wound on the outer circumference of the winding unit 330.

Thus, if the user pulls the extendable umbrella stick 100 to the maximum, the catching protrusion 231 of the umbrella ribs 230 reaches the upper end of the winding unit 330, and the rings of the fixing ribs 120 are restricted by the catching protrusions 231 and thus not slide further, thereby preventing the fixing ribs 120 from escaping from the umbrella ribs 230.

If the umbrella ribs 230 and the sheltering member 220 are completely received in the outer space 311*a*, as shown in FIG. 8, in a state where the extendable umbrella stick 100 is retracted and received in the inner space 311*b*, the upper cover 313 is closed and the fixing protrusion 101 is fixed to the fixing groove 323.

Meanwhile, if the user wants to unfold the umbrella and use it again, the user opens the upper cover 313 and separates the fixing protrusion 101 from the fixing groove 323, as shown in FIG. 3. Thereafter, if the user pulls the catching protrusion 231, the extendable umbrella stick 100 is extended, and then the user moves down the lifting member 110 along the extendable umbrella stick 100 and fixes it to the extendable umbrella stick 100, thereby unfolding the umbrella ribs 230 and the sheltering member 220.

A portable and compact umbrella according to another embodiment of the present invention will be explained with reference to the accompanying drawings.

FIG. 9 is a schematic view showing a portable and compact umbrella according to another embodiment of the present invention, and FIGS. 10 and 11 are sectional view showing the configuration and operation of the portable and compact umbrella according to the other embodiment of the present invention.

As shown in the figures, the portable and compact umbrella according to the other embodiment of the present invention generally includes an outer umbrella stick 400, a pressing member 500, an extendable umbrella stick 100, a sheltering means 200A, an adjusting member 600 and a handle member 300A.

The outer umbrella stick 400 is extended and retracted telescopically and thus its length can be changed, wherein the pressing member 500 is provided at one side of the outer umbrella stick 400 and the other side thereof is inserted into and fixed to the handle member 300A.

The pressing member 500 is installed at an upper end of the outer umbrella stick 400 so as to press the outer umbrella stick 400 when the outer umbrella stick 400 is retracted. The pressing member 500 is a ring-type circular plate having a first through hole 501 formed at its center such that the sheltering means 200A, i.e., a sheltering member 220 and umbrella ribs 230 connected to a support member 240, which will be described later, can pass through the first through hole.

The extendable umbrella stick 100 can be telescopically extended and retracted and thus its length can be changed like the outer umbrella stick 400. The extendable umbrella stick 100 is provided inside of the outer umbrella stick 400. In addition, the sheltering means 200A is provided at one side of the extendable umbrella stick 100, and a fixing protrusion 101 is provided at the other side thereof. The extendable umbrella stick 100 and the fixing protrusion 101 are substantially identical to those of the previous embodiment, so that the overlapping descriptions will be omitted herein.

The sheltering means 200A includes the support member 240, the sheltering member 220 and the umbrella ribs 230. The umbrella ribs 230 and the extendable umbrella stick 100 are connected by means of a link member 140. The support member 240, the sheltering member 220, the umbrella ribs 230 and the link member 140 are also substantially identical to those of the former embodiment, so that the overlapping descriptions will be omitted herein.

However, a thread is formed on the outer circumference of the support member 240 such that the adjusting member 600 is screwed thereto.

The adjusting member 600 is screwed to the support member 240 and thus moves up and down along the support member 240 as shown in FIGS. 12 to 14. The adjusting member 600 includes a lower adjusting member 610 and an upper adjusting member 620.

The lower adjusting member 610 is screwed to an upper portion of the outer circumference of the support member 240 to be movable up and down, and the lower adjusting member 610 has lower grooves 611 formed at positions corresponding to the umbrella ribs 230 so that the umbrella ribs 230 are seated therein.

The upper adjusting member 620 is screwed to a lower portion of the outer circumference of the support member 240 to be movable. The upper adjusting member 620 has upper grooves 621 formed at positions corresponding to the umbrella ribs 230 so that the umbrella ribs 230 pass through the upper grooves when being gathered in the upper direction.

In addition, a catching protrusion 231 formed at the end of each umbrella rib 230 is preferably formed wider than a cross sectional area of the umbrella rib 230. Thus, when the outer umbrella stick 400 is retracted, the catching protrusions 231 are caught into the first through hole 501 of the pressing member 500 and protrude upward from the pressing member 500. At this time, the catching protrusion 231 may be designed in various shapes such as a ring or stepped shape so that it can be caught to the circumference of the first through hole 501 of the pressing member 500.

The handle member 300A includes a case 350 having both ends communicating with each other and provided with an upper cover 313 for covering one of the end openings; a lower cover 320 screwed to the other end opening of the case 350; and a cylindrical winding unit 330 integrally provided at one end of the lower cover 320 to partition a receiving space 351*b* of the case 350 into an inner space 351*c* and an outer space 351*d*.

The lower cover 320 and the winding unit 330 are substantially identical to those of the former embodiment, so that the overlapping descriptions will be omitted herein.

However, a seating unit 355 is provided at an upper space 351*a* of the case 350 and is formed integrally with a partitioning unit 353 to extend therefrom such that a spring member 410 is placed thereon. In addition, the seating unit 355 is formed with a second through hole 355*a* such that the extendable umbrella stick 100, the support member 240 and the adjusting member 600 pass through the second through hole. Thus, the first through hole 501, the upper end of the case 350, the second through hole 355*a*, and the inside of the winding unit 330, i.e., the inner space 351*d* communicate with each other such that the extendable umbrella stick 100 passes therethrough.

The spring member 410 has one side fixed to the pressing member 500 and the other side installed to the inside of the outer umbrella stick 400 so as to be installed to the outer circumference of the seating unit 355. Thus, the spring member 410 provides elastic force such that the outer umbrella stick 400 is extended out of the handle member 300A.

In addition, a catching device 360, which prevents the pressing member 500 from being advanced by the spring member 410, is provided at the upper side of the case 350.

The catching device 360 includes a ball 361 for pressing and supporting the upper surface of the pressing member 500; a spring 363 for pushing the ball 361 toward the support member 240; and an adjusting unit 365 connected to the ball 361 in order to retreat the ball 361.

However, the catching device 360 is not limited to the above example if it can fix the pressing member 500 or release the fixation.

In addition, reference numeral 250 designates a fixing member installed at the upper center of the support member 240 so as to fixedly support the sheltering member 220 installed to the upper portion of the umbrella ribs 230. The sheltering member 220 fixed to the fixing member 250 is also fixedly supported on one side of the umbrella ribs 230, as shown in FIG. 15. At this time, the umbrella ribs 230 and the sheltering member 220 may be fixedly supported in various ways, for example by taping adhesion using a tape 260, bonding adhesion and heating adhesion.

Now, the operation of the portable and compact umbrella so configured according to the other embodiment of the present invention will be explained.

When intending to store the umbrella, a user rotates the lower adjusting member 610 and the upper adjusting member 620 to position the lower grooves 611 and the upper grooves 621 to the locations at which the umbrella ribs 230 are positioned so that the umbrella ribs 230 are pushed up and gathered. Then, the user rotates the umbrella ribs 230 upward such that they are gathered.

If the umbrella ribs 230 are gathered as mentioned above, the user pulls the extendable umbrella stick 100 protruding from the lower end of the handle member 300A. Then, the extendable umbrella stick 100 passes through the first through hole 501 of the pressing member 500, the second through hole 35*a* of the seating unit 355, and the winding unit 330 and then advances downward. Since the support member 240 provided at the upper end of the extendable umbrella stick 100 does not pass through the upper end of the winding unit 330, the link member 140 connecting the support member 240 with the extendable umbrella stick 100 is bent and slidingly inserted into the screw hole 331. If the user keeps pulling the extendable umbrella stick 100 in this state, the link member 140 is rotated and moves down along the screw hole 331, and at the same time, the support member 240, the umbrella ribs 230 and the sheltering member 220 are wound around the outer circumference of the winding unit 330. At this time, the support member 240, the umbrella ribs 230 and the sheltering member 220 are received in the outer space 351*c* without being tangled along the screw protrusion 333 formed on the outer circumference of the winding unit 330.

Thereafter, if the user pulls the extendable umbrella stick 100 to the maximum, the catching protrusion 231 of the umbrella ribs 230 reaches the first through hole 501 of the pressing member, and the catching protrusion 231 not passing through the first through hole 501 is inserted into the upper space 351*a* of the handle member 300A together with the pressing member 500. At this time, the outer umbrella stick 400 is retracted, and the outer umbrella stick 400 is received in the upper space 351*a* as the spring member 410 is compressed. Also, the outer umbrella stick 400 is fixed as the pressing member 500 is caught by the catching device 360.

If the outer umbrella stick 400 is received in the upper space 351*a* and the umbrella ribs 230 and the sheltering member 220 are completely received in the outer space 351*c*, in a state where the extendable umbrella stick 100 is retracted received in the inner space 351*d*, the user closes the upper cover 313 and fixes the fixing protrusion 101 to the fixing groove 323.

Meanwhile, when a user wants to unfold and use the umbrella, the user opens the upper cover 313 and separates the fixing protrusion 101 from the fixing groove 323. Then, if the user releases the pressing member 500 caught by the catching device 360, the compressed spring member 410 expands to push up the support member 240.

At this time, as the catching protrusions 231 supported on the upper surface of the pressing member 500 are also pushed, the umbrella ribs 230 are unfolded. As the umbrella ribs 230 are unfolded, the sheltering member 220 is also unfolded. Thereafter, the user rotates the upper adjusting member 620 such that the lower grooves 611 of the lower adjusting member 610 and the upper grooves 621 of the upper adjusting member 620 miss each other. Accordingly, the umbrella ribs 230 are seated in the lower grooves 611 of the lower adjusting member 610 and at the same time brought into close contact with the lower surface of the upper adjusting member, thereby fixing the umbrella ribs 230.

The invention claimed is:

1. A portable and compact umbrella, comprising:

an extendable umbrella stick extendable and retractable to change its length, the extendable umbrella stick having a sheltering means provided at one side thereof and a fixing protrusion provided at the other side thereof; and a handle member having both ends communicating with each other and a receiving space defined therein, the receiving space being partitioned by a cylindrical winding unit, the winding unit having an inner space formed inside thereof so that the extendable umbrella stick is retracted and received in the inner space, the winding unit having an outer space formed outside thereof so that the sheltering means is wound around the winding unit and received in the outer space, wherein a screw hole and a screw protrusion are formed to be spaced apart from each other on an outer circumference of the winding unit so that the sheltering means is wound thereon.

2. The portable and compact umbrella as claimed in claim 1, wherein the sheltering means includes:

a support member installed to an upper end of the extendable umbrella stick;

a sheltering member installed to the support member; and a plurality of flexible umbrella ribs provided at regular intervals for supporting the sheltering member in the rear thereof, one ends of the umbrella ribs being radially coupled to the support member.

3. The portable and compact umbrella as claimed in claim 2, wherein a link member having at least one stage is provided at the upper end of the extendable umbrella stick, whereby the extendable umbrella stick is connected to the support member through the link member.

4. The portable and compact umbrella as claimed in claim 2, wherein the umbrella ribs are pivotally installed to first installation grooves formed on the support member, respectively.

5. The portable and compact umbrella as claimed in claim 2, wherein the support member has an outer diameter larger than an inner diameter of the winding unit.

6. The portable and compact umbrella as claimed in claim 2, further comprising:

a ring-type lifting member moving up and down along an outer circumference of the extendable umbrella stick and provided to be fixed to or released from a point of the extendable umbrella stick; and fixing ribs having one ends radially installed to the lifting member and the other ends installed to the umbrella ribs and sliding along the umbrella ribs, respectively.

7. The portable and compact umbrella as claimed in claim 6, wherein a ring is formed at the other end of each fixing rib so that the corresponding umbrella rib is inserted therein, whereby the ring prevents the fixing rib from escaping from the umbrella rib.

8. The portable and compact umbrella as claimed in claim 6, wherein the fixing ribs are pivotally installed to second installation grooves formed on the lifting member, respectively.

9. The portable and compact umbrella as claimed in claim 6, wherein the lifting member has an outer diameter smaller than an inner diameter of the winding unit.

10. The portable and compact umbrella as claimed in claim 1, wherein the handle member includes a case having both ends communicating with each other and having an upper cover for covering one of end openings of the case and a lower cover screwed to the other of the end openings thereof, the winding unit is integrally formed at one end of the lower cover, and a fixing groove is formed on the other end of the lower cover, the fixing protrusion of the extendable umbrella stick being screwed to the fixing groove.

11. A portable and compact umbrella, comprising:

an outer umbrella stick extendable and retractable to change its length, an extendable umbrella stick provided inside of the outer umbrella stick to be extendable and retractable to change its length;

a support member installed at an upper end of the extendable umbrella;

a sheltering member installed to the support member;

a plurality of flexible umbrella ribs provided in the rear of the sheltering member at regular intervals to support the sheltering member, one ends of the umbrella ribs being radially coupled to the support member;

an adjusting member installed to the support member to control the umbrella ribs to be unfolded or gathered;

a pressing member installed to an upper end the outer umbrella stick to press the outer umbrella stick when the outer umbrella stick is retracted, the pressing member having a first through hole so that the umbrella ribs and the sheltering member connected to the support member pass through the first through hole;

a handle member having both ends communicating with each other and a receiving space defined therein, the receiving space being partitioned into an upper space and a lower space by a partitioning unit, the outer umbrella stick being retracted and received in the upper space, the lower space being partitioned by a cylindrical winding unit, the winding unit having an inner space formed inside thereof so that the extendable umbrella stick is retracted and received in the inner space, the winding unit having an outer space formed outside thereof so that the umbrella ribs and the sheltering member are wound around the winding unit and received in the outer space;

a catching device installed to an upper end of the handle member to catch or release the pressing member; and a spring member installed in the outer umbrella stick to provide elastic force so that the outer umbrella stick is extended out of the handle member.

12. The portable and compact umbrella as claimed in claim 11, wherein a screw hole and a screw protrusion are formed to be spaced apart from each other on an outer circumference of the winding unit so that the umbrella ribs and the sheltering member are wound thereon.

13. The portable and compact umbrella as claimed in claim 11, wherein a catching protrusion wider than a cross sectional area of each umbrella rib is provided on the other end of the umbrella rib, the catching protrusion being caught to the first through hole and protruding above the pressing member when the outer umbrella stick is retracted.

14. The portable and compact umbrella as claimed in claim 11, wherein the handle member includes a case having both ends communicating with each other and having an upper cover for covering one of end openings of the case and a lower cover screwed to the other of the end openings thereof, the winding unit is integrally formed at one end of the lower cover, and a fixing groove is formed on the other end of the lower cover, the fixing protrusion of the extendable umbrella stick being screwed to the fixing groove.

15. The portable and compact umbrella as claimed in claim 11, wherein a seating unit is formed in the upper space of the handle member to integrally extend from the partitioning unit so that the spring member is seated on the seating unit, the seating unit being formed with a second through hole so that the extendable umbrella stick, the support member and the adjusting member pass through the second through hole.

16. The portable and compact umbrella as claimed in claim 11, wherein the adjusting member includes:

a lower adjusting member screwed to an upper portion of an outer circumference of the support member to be movable up and down, the lower adjusting member being formed with lower grooves at positions corresponding to the umbrella ribs so that the umbrella ribs are seated therein; and an upper adjusting member screwed to a lower portion of the outer circumference of the support member to be movable up and down, the upper adjusting member being formed with upper grooves at positions corresponding to the umbrella ribs so that the umbrella ribs passes through the upper grooves when the umbrella ribs are gathered.

17. The portable and compact umbrella as claimed in claim 11, wherein a link member having at least one stage is provided at the upper end of the extendable umbrella stick so that the extendable umbrella stick is connected to the support member through the link member.

18. The portable and compact umbrella as claimed in claim 11, wherein the catching device includes:

a ball for pressing and supporting an upper surface of the pressing member;

a spring for pushing the ball toward the support member; and an adjusting unit connected to the ball to retreat the ball.

19. A portable and compact umbrella, comprising:

an extendable umbrella stick extendable and retractable to change its length, the extendable umbrella stick having a sheltering means provided at one side thereof and a fixing protrusion provided at the other side thereof; and a handle member having both ends communicating with each other and a receiving space defined therein, the receiving space being partitioned by a cylindrical winding unit, the winding unit having an inner space formed inside thereof so that the extendable umbrella stick is retracted and received in the inner space, the winding unit having an outer space formed outside thereof so that the sheltering means is wound around the winding unit and received in the outer space, wherein the handle member includes a case having both ends communicating with each other and having an upper cover for covering one of end openings of the case and a lower cover screwed to the other of the end openings thereof, wherein the winding unit is integrally formed at one end of the lower cover, and a fixing groove is formed on the other end of the lower cover, the fixing protrusion of the extendable umbrella stick being screwed to the fixing groove.

* * * * *